US007304233B2

(12) United States Patent
Suzuki et al.

(10) Patent No.: US 7,304,233 B2
(45) Date of Patent: Dec. 4, 2007

(54) APPARATUS AND METHOD FOR INSTALLING UNIT ON A STRINGED MUSICAL INSTRUMENT

(75) Inventors: Keisuke Suzuki, Hamamatsu (JP); Hiroshi Imamura, Hamamatsu (JP); Yoshifumi Sakai, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 245 days.

(21) Appl. No.: 11/147,734

(22) Filed: Jun. 8, 2005

(65) Prior Publication Data

US 2006/0278067 A1 Dec. 14, 2006

(51) Int. Cl.
*G10H 1/32* (2006.01)
*G10H 3/00* (2006.01)

(52) U.S. Cl. ..... 84/743; 84/718

(58) Field of Classification Search ..... None
See application file for complete search history.

(56) References Cited

U.S. PATENT DOCUMENTS 7,145,064 B2 * 12/2006 Geiger ..... 84/294
7,151,216 B1 * 12/2006 Hutmacher ..... 84/723
2002/0162443 A1 * 11/2002 Pittman ..... 84/453
2003/0121395 A1 * 7/2003 Smith ..... 84/327
2005/0087062 A1 * 4/2005 Kiyohiko ..... 84/723
2005/0172785 A1 * 8/2005 Fisher-Robbins et al. . 84/464 R

* cited by examiner

*Primary Examiner*—Marlon Fletcher
(74) *Attorney, Agent, or Firm*—Foley & Lardner LLP

(57) ABSTRACT

An apparatus for mounting a control unit on a stringed musical instrument. The apparatus is designed such that the control unit can be easily mounted on and removed from the stringed musical instrument. The apparatus provides more stable and more firm mounting of the control unit compared to similar apparatuses of the past. The apparatus facilitates the mounting of the control unit on either the front surface of the stringed musical instrument or the rear surface of the stringed musical instrument. When mounting the control unit on the front surface of the stringed musical instrument, the apparatus also facilitates mounting the control unit above the bridge of the stringed musical instrument.

31 Claims, 9 Drawing Sheets

APPARATUS AND METHOD FOR INSTALLING UNIT ON A STRINGED MUSICAL INSTRUMENT

BACKGROUND OF THE INVENTION

1. Field of the Invention

Embodiments of the present invention relate, generally, to an apparatus for mounting a control unit onto various stringed musical instruments.

2. Related Art

For some time, pickups that detect string vibrations have been installed on the bodies of stringed musical instruments such as guitars and the like. Also known are main control units for the pickups (hereinafter, referred to as "main control units") that have a volume control for controlling an output level of the pickup and a connector for interfacing with a connecting cord connects that transmits the controlled signal. This kind of main control unit is mounted on the stringed musical instrument by an attachment apparatus configured such that it is possible to mount the main control unit on various stringed musical instruments.

The pickup systems marketed by the Roland Corp. under the trademarks GK-2™ and GK-3™ are examples of the system described above. These systems have a main control unit and a holder, which is the attachment apparatus for the main control unit. An explanation will be given regarding the GK-3™ main control unit and the attachment apparatus for the main control unit in reference to FIG. 8 and FIG. 9

FIG. 8 is an exterior view drawing that shows the pickup 30 and the main control unit 20. The pickup 30, which is arranged below the strings of a guitar and the like, is the divided pickup that detects the vibrations of each string independently, and the center mark 30*a* that is shown located in the middle of the pickup 30 is positioned in the middle of a plurality of strings. The pickup is affixed to the body of the guitar either by screwing down the pickup using screws that are inserted into the screw holes 30*b* that have been disposed on both ends of the pickup 30 or by sticking double sided tape on the bottom surface of the pickup 30.

The signal that is detected by the pickup 30 is input to the main control unit 20 via the pickup cable 29. The main control unit 20 is furnished with a volume control 22, an input jack 24, a toggle switch 25, a connector 23, a down switch 26, an up switch 27, and a power indicator 28.

The volume control 22 is a variable resistor that adjusts the level of the signal that has been input via the pickup cable 29. The outputs of other pickups, with which the guitar is furnished, are input to the input jack 24 via a normal guitar cable. The toggle switch 25 toggles any one of the signals that have been input to the input jack 24, the signal, the level of which has been adjusted by the volume control 22, and a signal that is a composite of the signal that has been input to the input jack 24 and the signal, the level of which has been adjusted by the volume control 22. The toggled signal is output to an external device from the connector 23.

The down switch 26 and the up switch 27 facilitate the transmission of the signal to an external device via the connector 23. The power indicator 28, which indicates that power has been supplied to the main control emit 20 when power is supplied via the connector 23, is disposed on the side of the volume control 22.

The state in which the main control unit 20 is mounted on a stringed musical instrument such as a guitar and the like is shown in FIG. 9. The main control unit 20 is configured such that the mounting on the body 60 of the stringed musical instrument is done by a holder. The holder is one that uses two holders made of metal having an "L" shape. A first holder 51 attaches to the main control unit 20 and has a first contact plate 51 a, which contacts the front surface of the body 60 of the stringed musical instrument and a first side plate 51*b*, which is formed perpendicular to the first contact plate 51*a* and contacts the side surface of the body 60 of the stringed musical instrument. A groove 51*c*, into which an end pin 61 is inserted, and a bolt 52 for fastening a second holder 53 are disposed on the first side plate 51*b*.

The second holder 53 is configured with a second contact plate 53*a*, which contacts the rear surface of the body 60 of the stringed musical instrument, and a second side plate 53*b*, which is formed perpendicular to the second contact plate 53*a* and contacts the first side plate 5*b* of the first holder 51 running along the side surface of the body 60. A bolt 52 is formed on and extends from the side plate 5*b*. An elongated hole 53*c*, which receives the bolt 52 that has been provided on the first side plate 5*b*, is formed in the second side plate 53*b*.

To mount the main control unit 20 on the body 60 of the stringed musical instrument, first, the main control unit 20 is attached to the first holder 51. Next, an end pin 61 of the stringed musical instrument is loosened, and the groove 51*c* that has been formed in the first side plate 51*b* of the first holder 51 is inserted on the threaded section of the end pin 61. Next, the contact plate 51*a* of the first holder 51 is brought into contact with the front surface of the stringed musical instrument, and the end pin 61 is tightened to fasten the main control unit 20.

Next, the bolt 52 that is provided on the first side plate 51*b* is inserted into the elongated hole 53*c* in the second side plate 53*b* of the second holder 53, and the contact plate 53*a* of the second holder 53 is brought into contact with the rear surface of the stringed musical instrument. Then, a flat washer 54 and a spring washer 55 are inserted onto the bolt 52 that is provided on the first side plate 51*b*, and the holder is fastened using a cap nut 56.

To remove the main control unit 20 from the body 60 of the stringed musical instrument, the cap nut 56 is loosened, and the cap nut 56, the spring washer 55, the flat washer 54, and the second holder 53 are removed from the bolt 52. Next, the end pin 61 of the stringed musical instrument is loosened, and the main control unit 20 is removed by lifting up the groove 51*c* of the first holder 51 along the end pin 61. The end pin 61 is, then, screwed into the body 60, returning the stringed musical instrument to a state existing before the main control unit 20 was mounted.

Bodies of conventional stringed musical instruments have been made in various shapes and with different arrangements of the volume control and the like. As a result, there have been cases in which the pickup main control unit 20 cannot be mounted on the body of the stringed musical instrument. In addition, in the past, methods such as attaching the pickup main control unit to the body of the stringed musical instrument with double-sided tape or adhesive were used. However, in many cases with these methods, the stringed musical instrument became dirty, and it was not possible to easily remove the main control unit 20.

In the methods described above, the pickup main control unit is affixed to a holder, and the holder is fastened to the body of the stringed musical instrument using the end pin of the stringed musical instrument. Because force is not applied to the body of the stringed musical instrument in the holding direction, the attachment can be weak and unstable.

In accordance with cases described above, the pickup main control unit is mounted on the body of a stringed musical instrument using a holder, and the procedure for attaching or removing the main control unit to or from the body of the stringed musical instrument is complicated.

SUMMARY OF THE DISCLOSURE

Embodiments of the present invention solve problems as discussed above and provide a pickup main control unit attachment apparatus that can be easily mounted and removed without regard to the type of stringed musical instrument.

In order to achieve this object, a first embodiment of the present invention provides: a first holder that has a first contact plate that is affixed to the main control unit and that is in contact with the front surface or the rear surface of the stringed musical instrument; a second holder that has a second contact plate that is in contact with the rear surface or the front surface of the stringed musical instrument; and a linking element that links the first holder and the second holder such that the body of the stringed musical instrument is held in a pressed state between the first holder and the second holder.

Further, in the first embodiment, the first holder has a first side plate that is disposed roughly perpendicular to the first contact plate, and the first side plate has grooves that are disposed on both sides of the side plate extending in a direction that is perpendicular to the first contact plate. Also, the second holder has a second side plate that is disposed standing on the second contact plate, and both ends of the second side plate slide along the grooves of the first side plate. The first contact plate and first side plate are joined, perhaps forming an acute angle. The second contact plate and second side plate are joined, perhaps forming an acute angle.

Further, in the first embodiment, the apparatus has a first elastic member that adheres to the side of the first contact plate that is in contact with the stringed musical instrument or a second elastic member that adheres to the side of second contact plate that is in contact with the stringed musical instrument. The apparatus may have both first and second elastic members. Further, the elastic members may be formed from urethane foam.

Further, in the first embodiment, the first side plate has a curved surface that runs along the side surface of the stringed musical instrument. The curved surface of the first side plate may also have at least two convex portions that are in contact with the side surface of the stringed musical instrument.

In addition, the first side plate may be formed by the extrusion molding of aluminum, and the second side plate may be formed by the press molding of steel plate. The second side plate may also have a plurality of flat surfaces that run roughly along the curve of the curved surface of the first side plate. The first holder and the second holder may be linked via a hole formed in the first side plate along an axis roughly perpendicular to the first contact plate and a hole formed in the second holder. When a bolt is screwed through the holes of the first side plate and of the second holder, the body of the stringed musical instrument is held in a pressed state between the first and the second holders.

In a second embodiment of the present invention, the first holder and the second holder are formed and linked together as described in the first embodiment. However, when it is desired to install the main control unit on the front surface of the stringed musical instrument above the bridge of the stringed musical instrument, the main control unit may be attached to an attachment surface of a third holder. The third holder may have two side plates with which the third holder may be linked to the second holder. Also, an elastic member that adheres to the attachment surface may be disposed between the attachment surface and the surface of the stringed musical instrument.

DETAILED DESCRIPTION OF PREFERRED EMBODIMENTS

Figure 1A:
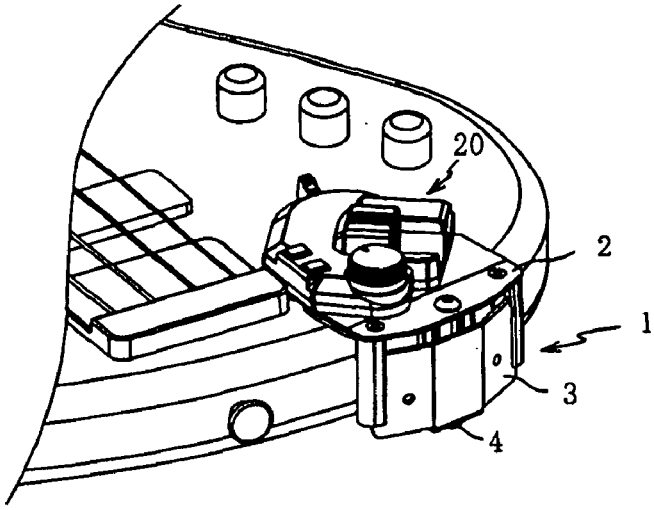
FIG. 1*a* is an oblique view drawing of a main control unit using the attachment apparatus of an embodiment of the present invention, wherein the main control unit has been mounted on the front surface of the body of the stringed musical instrument.
Figure 1B:
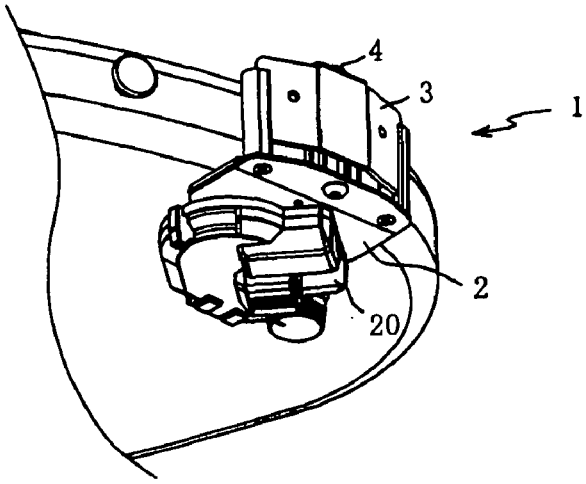
FIG. 1*b* is an oblique view drawing of the main control unit using the attachment apparatus of an embodiment of the present invention, wherein the main control unit has been mounted on the rear surface of the body of the stringed musical instrument.
Figure 1C:
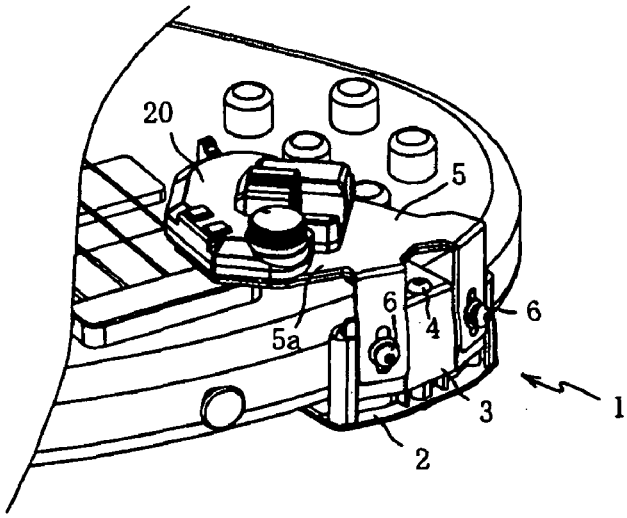
FIG. 1*c* is an oblique view drawing of the main control unit using the attachment apparatus of an embodiment of the present invention, wherein the main control unit has been mounted above the bridge of the stringed musical instrument.

An explanation will be given below regarding a preferred embodiment of the present invention while referring to the attached drawings. FIGS. 1*a*, 1*b* and 1*c* show a main control unit 20 that uses an embodiment of the present invention in a mounted state on a bass guitar. The bass guitar is an example of a "stringed musical instrument," with which embodiments of the invention may be employed. Other embodiments may operate with other suitable stringed musical instruments. FIG. 1*a* shows a case in which the main control unit 20 has been mounted on the front surface of the stringed musical instrument, FIG. 1*b* shows a case in which the main control unit 20 has been mounted on the rear surface of the stringed musical instrument, and FIG. 1*c* shows a case in which the main control unit 20 has been arranged above the bridge on the front side and mounted.

In the case of FIG. 1*a*, the main control unit 20 is affixed on a first holder 2. A bolt 4 is screwed down to hold the body of the stringed musical instrument between the first holder 2 and a second holder 3. The main control unit 20 is thereby mounted to the body of the stringed musical instrument.

In the case of FIG. 1*b*, the main control unit 20 is affixed on the first holder 2. The bolt 4 is screwed down to hold the body of the stringed musical instrument between the first holder 2 and the second holder 3. The main control unit 20 is thereby mounted to the body of the stringed musical instrument. However, the main control unit 20 is located on the rear surface of the body of the stringed musical instrument. In those cases where there is not sufficient space to mount the main control unit 20 on the front surface of the body of the stringed musical instrument, the main control unit 20 can be mounted using this method.

In the case of FIG. 1*c*, the body of the stringed musical instrument is held between the first holder 2 and the second holder 3 by screwing down the bolt 4, and a third holder 5 is fastened to the second holder 3 by a screw 6. The main control unit 20 is fastened to an attachment plate 5*a* that extends above the bridge of the stringed musical instrument.

Figure 2:
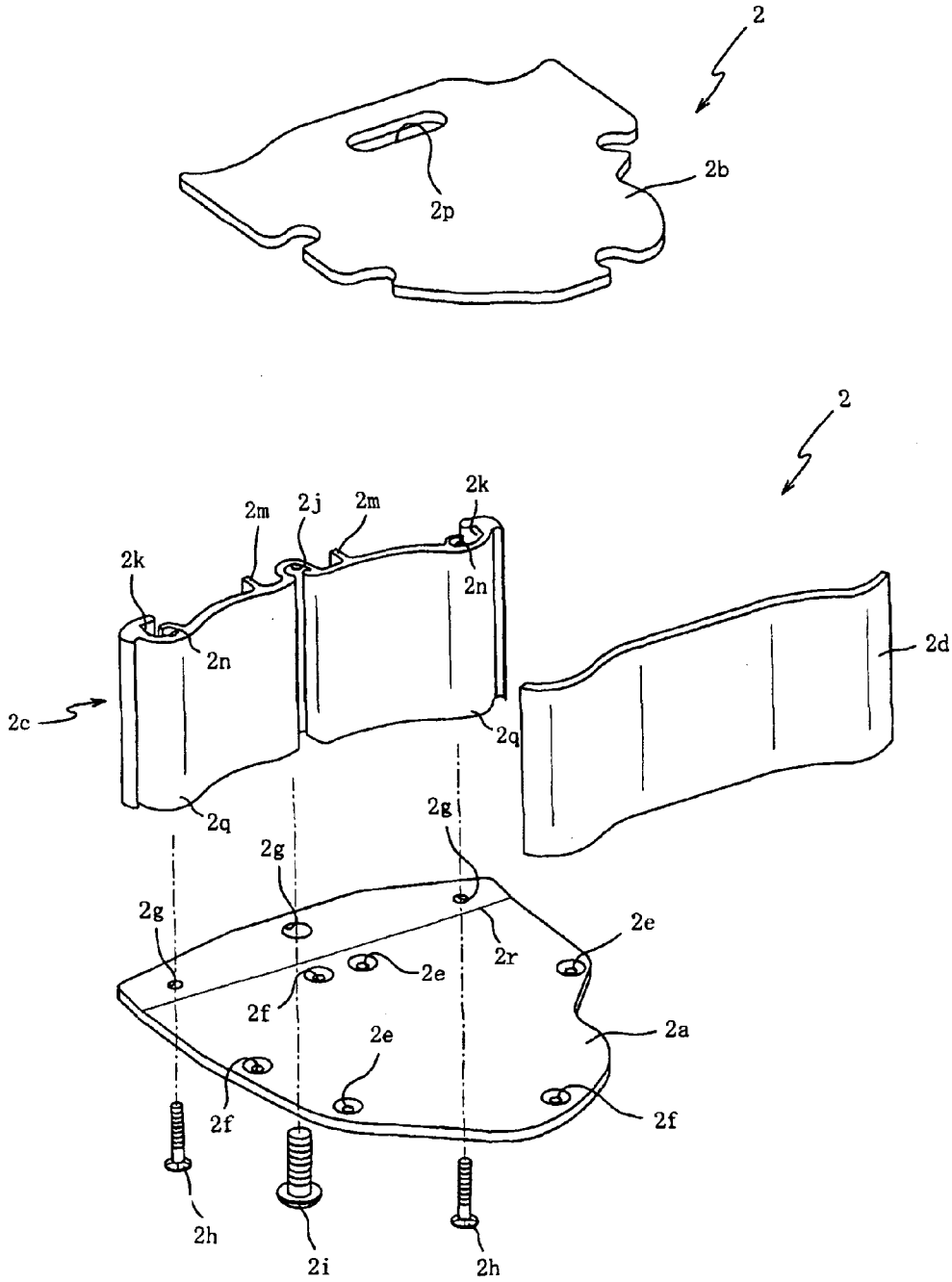
FIG. 2 is a disassembled, oblique view drawing of a first holder.

FIG. 2 is a disassembled oblique drawing of the first holder 2. The first holder 2 comprises a first contact plate 2*a*, a first cushion 2*b* that is affixed to the first contact plate 2*a*, a first side plate 2*c* that is screwed to the first contact plate 2*a*, and a second cushion 2*d* that is affixed to the first side plate 2*c*.

In an embodiment of the invention, the first cushion 2*b* is made of an elastic material characterized by a high coefficient of friction, and the second cushion 2*d* is made of a nonabrasive material. In a further embodiment of the invention, the first contact plate 2*a* is formed from a steel plate, the first cushion 2*b* is made of urethane foam, the first side plate 2*c* is an aluminum extrusion molded member, and the second cushion 2*d* is formed from felt.

The first contact plate 2*a* has six screw holes 2*e* and 2*f* disposed in order to fasten the main control unit 20 using the flat screws 20*c* (refer to FIG. 5), and a hole 2*p* and various notches are formed in the portions of the first cushion 2*b* that correspond to the screw holes 2*e* and 2*f* so that the screws can be inserted. The three screw holes 2*e* from among these six screw holes are used in those cases where the main control unit is mounted on the front surface of the stringed musical instrument, and the remaining three screw holes 2*f* are used in those cases where the main control unit 20 is mounted on the rear surface of the stringed musical instrument. Three female threaded portions 20*a* are formed on the rear surface of the main control unit 20 (refer to FIG. 5).

The first contact plate 2*a* is bent on a straight line 2*r* near the attachment position at which the first side plate 2*c* is attached such that the first contact plate 2*a* forms an angle of less than 90 degrees with the first side plate 2*c*. In a further embodiment of the invention, the angle formed by the first contact plate 2*a* and the first side plate 2*c* is 88 degrees. The configuration is such that when the body of the stringed musical instrument is held between the first contact plate 2*a* and the second contact plate 3*a*, the elasticity of the first contact plate 2*a* (by bending on the straight line 2*r* of the first contact plate 2*a*) is utilized.

The first cushion 2*b*, which, in the further embodiment of the invention, has been formed from urethane foam, is affixed to the surface of the first contact plate 2*a* that is in contact with the body of the stringed musical instrument with an adhesive. Urethane foam is a material that prevents damage to the stringed musical instrument and has flexibility, which makes it possible to link the first holder 2 to the second holder 3 and to utilize the force of the pressing on the front surface of the body of the stringed musical instrument, thereby firmly holding the body of the stringed musical instrument between the first holder 2 and the second holder 3.

The body of the stringed musical instrument may have an arched front surface that has been formed such that the middle portion of the body is expanded. Because of the flexibility of the urethane foam, the first cushion 2*b* changes shape and adheres closely to the body of the stringed musical instrument. In addition, since the coefficient of friction of the urethane foam is large, it is possible to firmly hold the body of the stringed musical instrument, thereby reducing the possibility of sliding with respect to the body of the stringed musical instrument.

The first side plate 2*c* is screwed down by flat screws 2*h* and a round screw 2*i* along a direction roughly perpendicular to the first contact plate 2*a*. The surface of the first contact plate 2*c* that is in contact with the stringed musical instrument has a curved section disposed such that the surface follows along the curve of the side surface of the body of the stringed musical instrument. Convex sections 2*q* are formed on both ends of the curved section. Since the side surface of the body of the stringed musical instrument is curved, if the first side plate 2*c* is formed with a flat surface, the side surface of the stringed musical instrument and the first side plate 2*c* will be in contact in only one place, and it will not be stable. Therefore, by disposing the convex sections 2*q* on at least both ends of the curved section in this manner, there is contact in at least two places and it is possible to carry out the mounting in a stable state. The second cushion 2*d* that has been formed from felt in order to prevent damage to the body of the stringed musical instrument is affixed to the first side plate 2*c* with an adhesive.

Guide grooves 2*k* are disposed on both ends on the side of the first side plate 2*c* opposite to the side on which the second cushion 2*d* is affixed. The guide grooves 2*k* are disposed in a direction that is roughly perpendicular to the first contact plate 2*a*. In the middle of the first side plate 2*c*, there is a round hole 2*j* into which the bolt 4 and the round screw 2*i* are screwed. Two ribs 2*m* that are parallel to the round hole 2*j* on both sides of the round hole 2*j* are formed parallel to the guide grooves 2*k*. In addition, round holes 2n receive the flat screws 2*h* that are inserted into the screw holes 2*g* in the contact plate 2*a*. The round holes 2*n* are formed positioned near the vicinity of the guide grooves 2*k*. Threads are cut into the round holes 2*n* and the round hole 2*j*; in these holes, the flat screws 2*h*, the round screw 2*i*, and the bolt 4 are screwed down.

In assembling the first holder 2, the flat screws 2*h* and the round screw 2*i* are inserted into screw holes 2*g* of the first contact plate 2*a* and screwed into the round holes 2*n* and the round hole 2*j* of the first side plate 2*c*. In addition, the first cushion 2*b* is affixed to the first contact plate 2*a*, and the second cushion 2*d* is affixed to the first side plate 2*c*.

Figure 3:
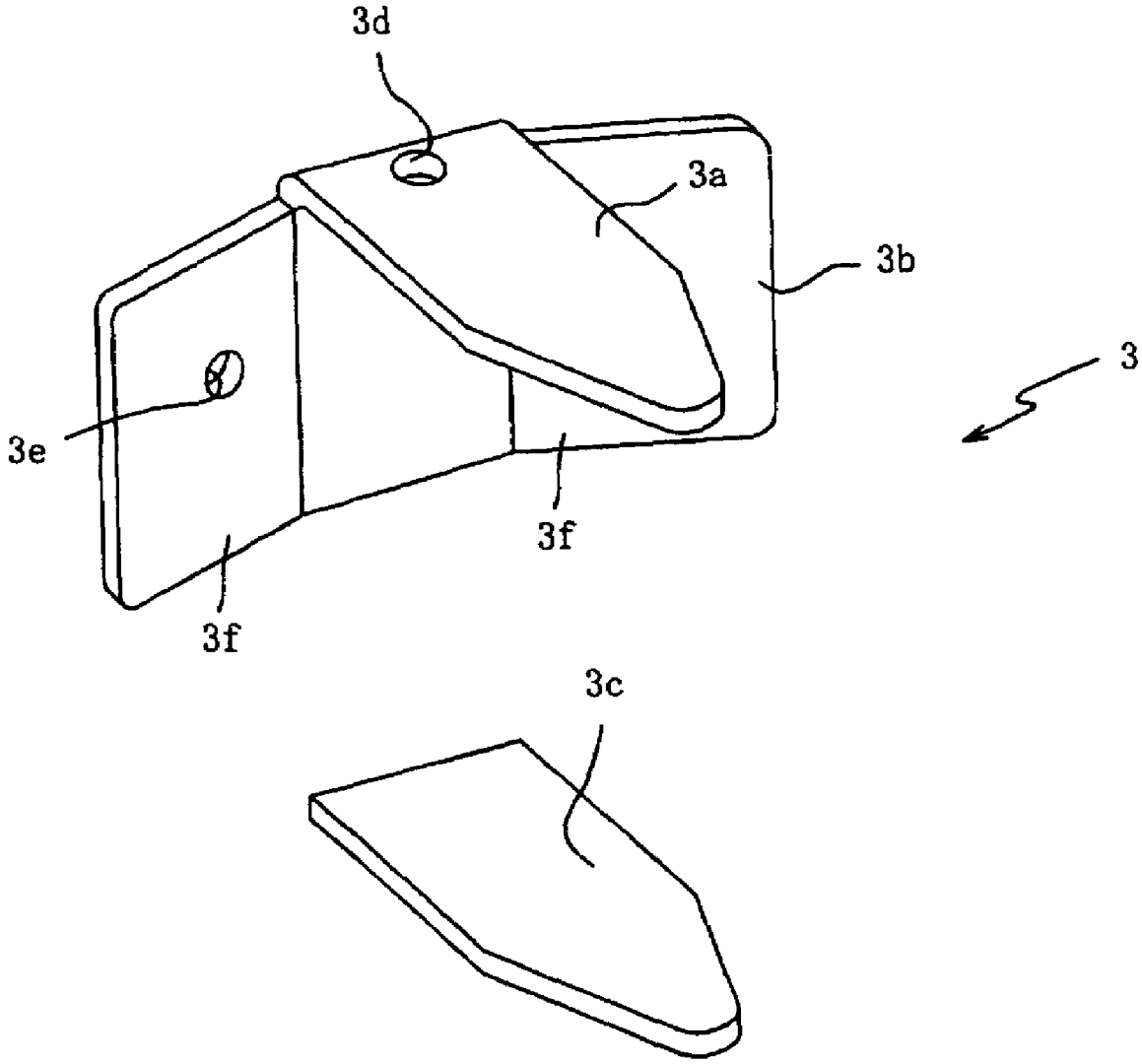
FIG. 3 is a disassembled, oblique view drawing of a second holder.

FIG. 3 is a disassembled oblique view drawing of the second holder 3. The second holder 3 comprises a second contact plate 3*a*, a second side plate 3*b*, and a third cushion 3*c*. The second contact plate 3*a* has an area that is smaller than that of the first contact plate 2*a* of the first holder 2 and is formed in a tongue shape with a tip shaped roughly as an isosceles triangle. The third cushion 3*c* is affixed to the surface that comes into contact with the stringed musical instrument. In a further embodiment of the present invention, the second contact plate 3*a* and the second side plate 3*b* are formed as a single unit by bending the second contact plate 3*a* from the second side plate 3*b* after the single unit is punched out of a steel plate or otherwise formed.

As was the case with the first holder 2, the bending angle of the second contact plate 3*a* and the second side plate 3*b* may be formed at about 88 degrees, and the configuration is such that when the body of the stringed musical instrument is held between the first contact plate 2*a* and the second contact plate 3*a*, the elasticity of the second contact plate 3*a* (by bending the second contact plate 3*a* from the second side plate 3*b*) is utilized.

In a further embodiment of the present invention, the third cushion 3*c* is, like the first cushion 2*b*, formed from urethane foam, thereby preventing damage to the stringed musical instrument. Due to the flexibility of the third cushion 3*c*, when the first holder 2 and the second holder 3 are linked, the pressing force on the front surface of the body of the stringed musical instrument is utilized, and it is possible to firmly hold the body of the stringed musical instrument between the first holder 2 and the second holder 3.

A screw hole 3*d*, which receives the bolt 4 for linking to the first holder 2, is formed at a position near the area at which the second side plate 3*b* of the second contact plate 3*a* is bent.

The second side plate 3*b* has two wings 3*f* that are inserted into guide grooves 2*k* that have been formed on both ends of the first side plate 2*c*. In a further embodiment of the invention, the two wings 3*f* are formed by bending the second side plate 3*b* such that the second side plate 3*b* follows the curvature of the first side plate 2*c*. Each of the two wings 3*f*and the surface that is between the two wings 3*f* are essentially flat surfaces and may be formed by press molding of steel plate. In addition, on each of the two wings 3*f*, female threads 3*e*, by which the third holder 5 is fastened, are disposed.

Figure 4:
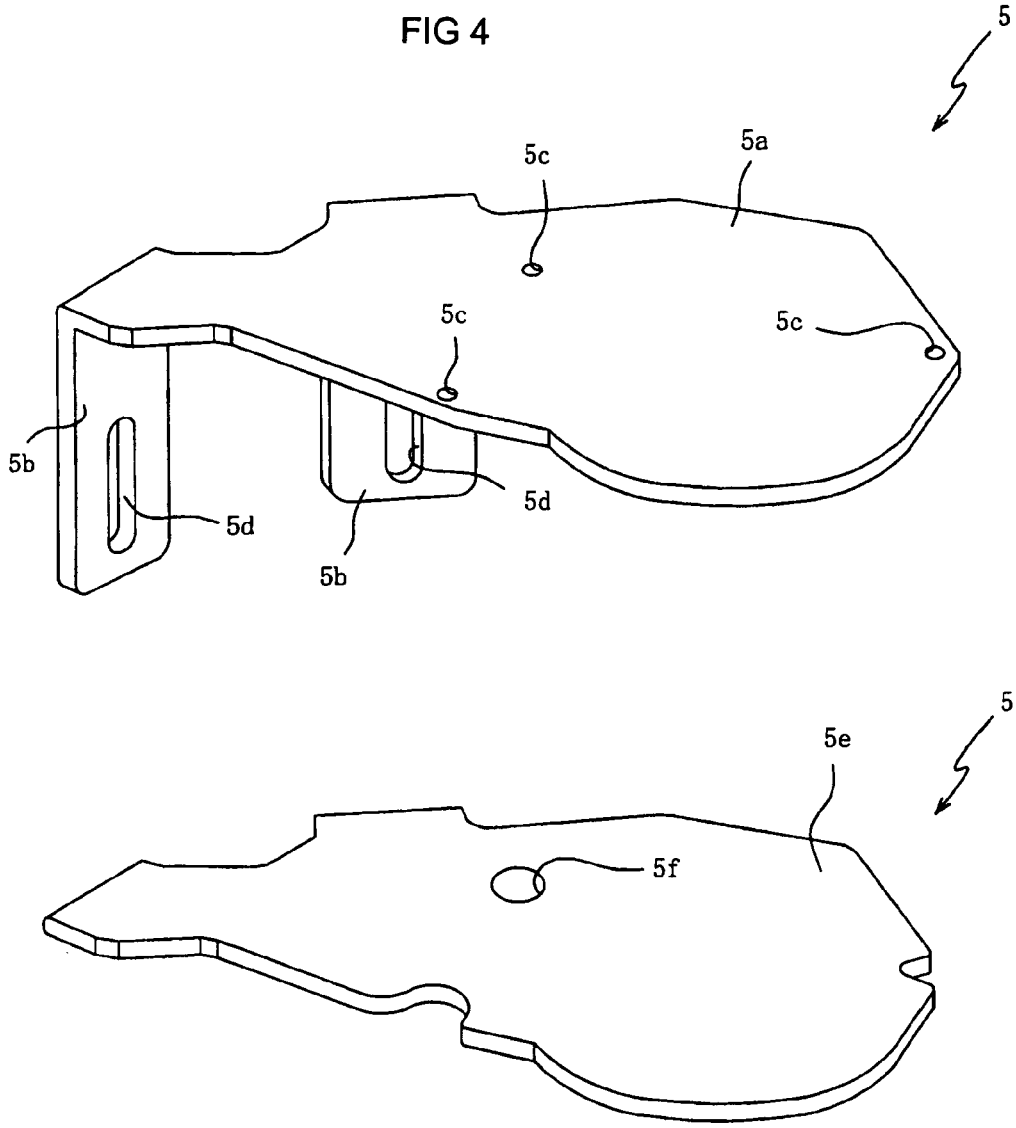
FIG. 4 is a disassembled, oblique view drawing of a third holder.

FIG. 4 is a disassembled oblique view drawing of the third holder 5. The third holder 5 comprises an attachment plate 5*a*, a fourth cushion 5*e* that is affixed to the attachment plate 5*a*, and two third side plates 5*b* that are disposed standing roughly perpendicular to the attachment plate 5*a*.

In a further embodiment of the invention, the attachment plate 5*a* and the two third side plates 5*b* are formed by bending a single unit stamped from steel plate, and the fourth cushion 5*e* is formed from felt. Three screw holes 5*c*, with which the main control unit 20 is fastened by flat screws 20*c*, are disposed on the attachment plate 5*a*. A hole 5*f* and various notches are formed in the portions of the fourth cushion Se that correspond to these screw holes 5*c* such that the screws can be inserted. Elongated holes 5*d*, which are elongated along a direction that is roughly perpendicular to the attachment plate 5*a*, are formed in each of the two third side plates 5*b*.

Figure 5C:
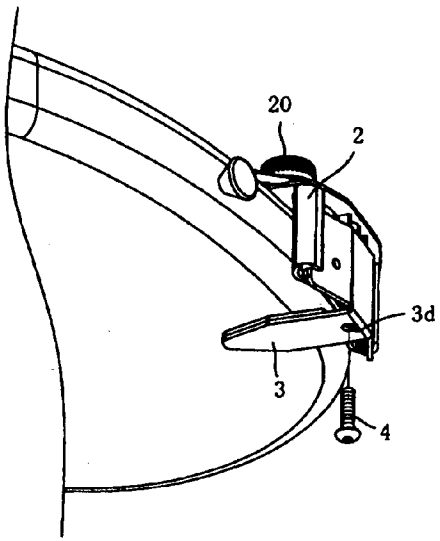
FIG. 5*c* shows a view from the rear side of the stringed musical instrument of the linking of the second and the first holders.
Figure 5B:
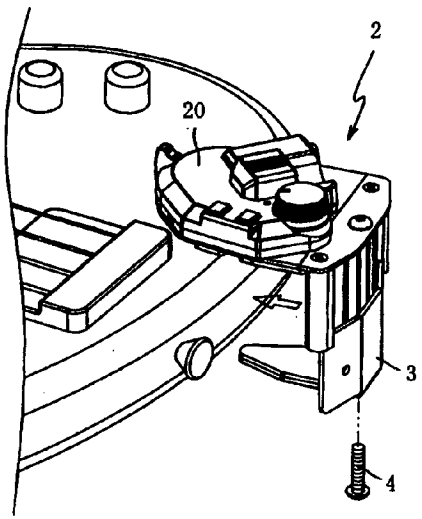
FIG. 5*b* shows a method in which the main control unit is disposed opposite to the front surface of the body of the stringed musical instrument, wherein the second holder is linked to the first holder.
Figure 5A:
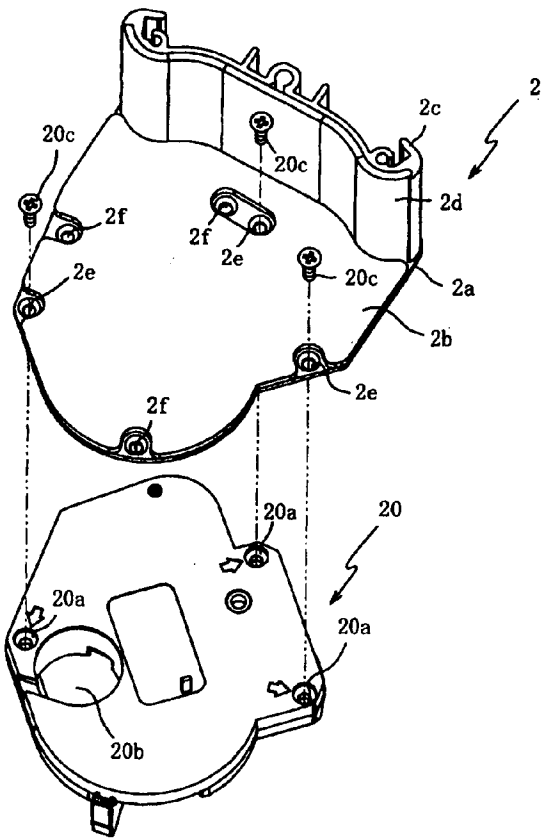
FIG. 5*a* shows a method in which the main control unit is disposed opposite to the front surface of the body of the stringed musical instrument, wherein the main control unit is fastened to the first holder.

FIG. 5*a*, FIG. 5*b*, and FIG. 5*c*show the details of the case that is shown in FIG. 1*a* in which the main control unit 20 is mounted on the front surface of the body of the stringed musical instrument. FIG. 5*a* shows a condition in which the main control unit 20 is mounted on the first holder 2. The flat screws 20*c* are inserted in the screw holes 2*e* in the first contact plate 2*a* and are screwed into the female threads 20*a* in the main control unit 20, thereby fastening the main control unit 20. The cylindrical open space 20*b* that accommodates the pickup cable 29 is formed in the bottom portion of the main control unit 20; and, in those cases where the pickup cable 29 is too long, it is possible to roll up the cable and store the cable in the open space 20*b*.

FIG. 5*b* shows a condition in which the main control unit 20 is fastened to the first holder 2. The two wings 3*f* of the second holder 3 are inserted into the guide grooves 2*k* of the first holder 2, the two ends of the second side plate 3*b* of the second holder 3 follow along the guide grooves 2*k*, the middle portion of the second side plate 3*b* slides along the ribs 2*m*, and the mounting is done such that the body of the stringed musical instrument is held between the first contact plate 2*a* and the second contact plate 3*a*.

FIG. 5*c* depicts a view from the rear side of the body of the stringed musical instrument of the state in which the first contact plate 2*a* is in contact with the front surface of the stringed musical instrument, the second contact plate 3*a* is in contact with the rear surface of the body of the stringed musical instrument, and the first side plate 2*c* is in contact with the side surface of the body of the stringed musical instrument. FIG. 5*c* also shows that the bolt 4 is inserted into the screw hole 3*d* in the second contact plate 3*a* and fastened to the female threads in the round hole 2*j* in the first side plate 2*c*. By screwing down the bolt 4, the first cushion 2*b* and the third cushion 3*c*, which are affixed, respectively, to the contact plate 2*a* of the first holder 2 and to the contact plate 3*a* of the second holder 3, are compressed. The body of the stringed musical instrument is held in a pressed state between them. In particular, when the first cushion 2*b* and the third cushion 3*c* are formed from urethane foam, which has a large coefficient of friction, the cushions and the body of the stringed musical instrument are closely pressed together, and firm fastening to the body of the stringed musical instrument is achieved.

Figure 6B:
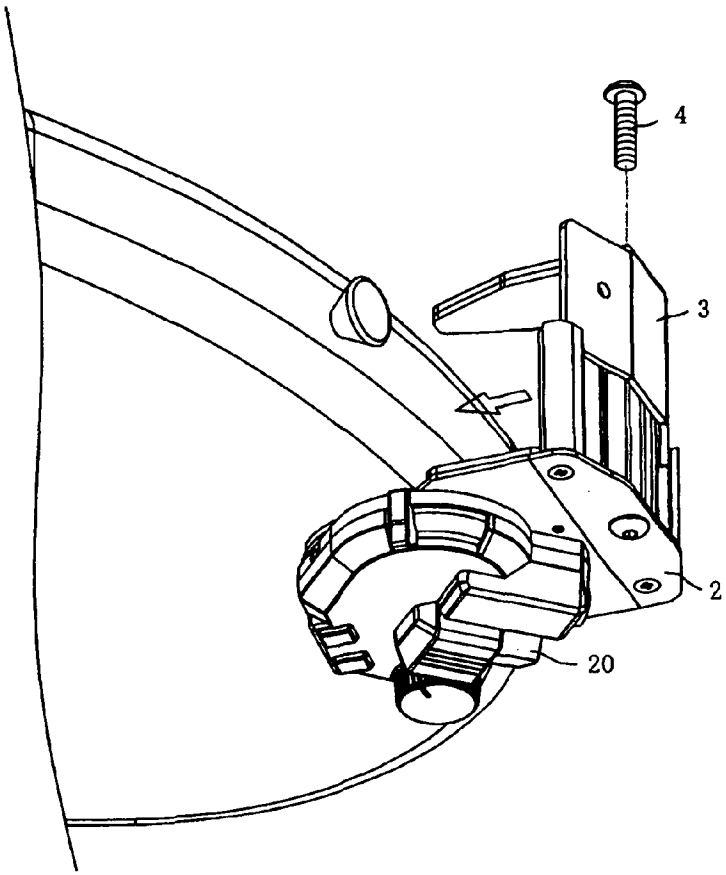
FIG. 6*b* shows a method with which the main control unit is disposed opposite to the rear surface of the body of the stringed musical instrument, wherein the second holder is linked to the first holder.
Figure 6A:
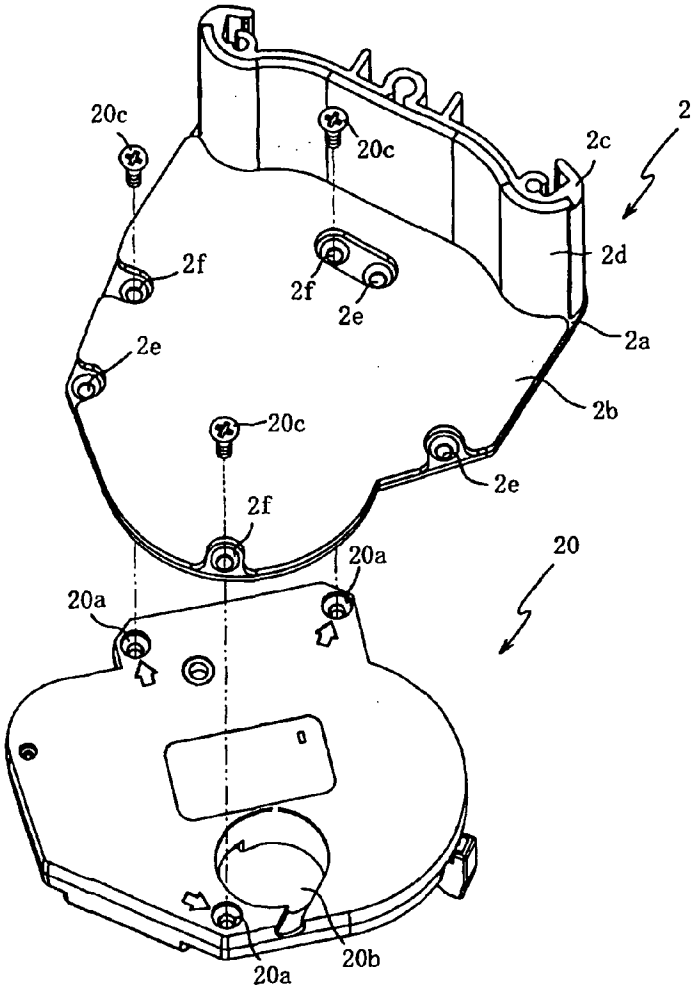
FIG. 6*a* shows a method with which the main control unit is disposed opposite to the rear surface of the body of the stringed musical instrument, wherein the main control unit is fastened to the first holder.

FIGS. 6*a* and 6*b* show the details of the case shown in FIG. 1*a* in which the main control unit 20 is mounted on the rear surface side of the body of the stringed musical instrument. FIG. 6*a* shows a condition in which the main control unit is mounted on the first holder 2. The flat screws 20*c* are inserted into the screw holes 2*f* in the first contact plate 2*a* and screwed down into the female threads 20*a* in the main control unit 20, fastening the main control unit 20. In those cases where the main control unit 20 is attached to the front surface of the stringed musical instrument in this manner and in those cases where the unit is attached to the rear surface of the stringed musical instrument, by changing the position on which the main unit 20 is mounted in the first holder 2, the connection cord with which the main control unit 20 is connected to the connector 23 is connected facing toward the lower rear.

FIG. 6*b* shows a condition in which the second holder 3 is mounted on the first holder 2 and the first and second holders are mounted on the stringed musical instrument. Since the method for linking the first holder 2 and the second holder 3 is the same as the case of the method shown in FIG. 2 in which the main control unit 20 is mounted on the front surface of the body of the stringed musical instrument, the description will be omitted.

Figure 7C:
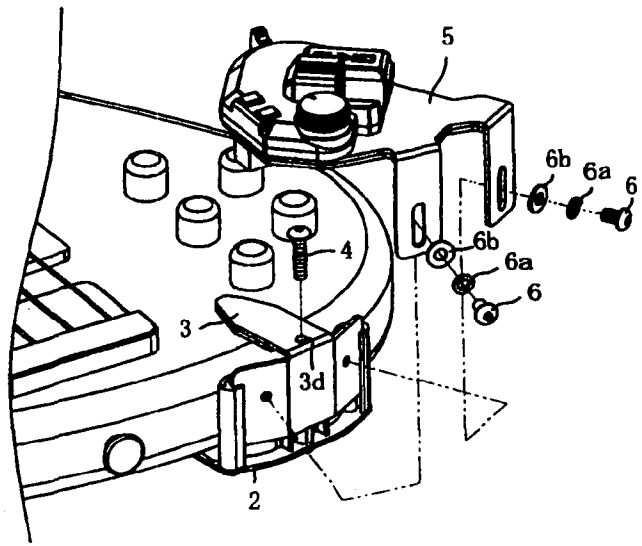
FIG. 7*c* shows a method in which the main control unit is disposed above the bridge of the stringed musical instrument, wherein the third holder is linked to the second holder.
Figure 7B:
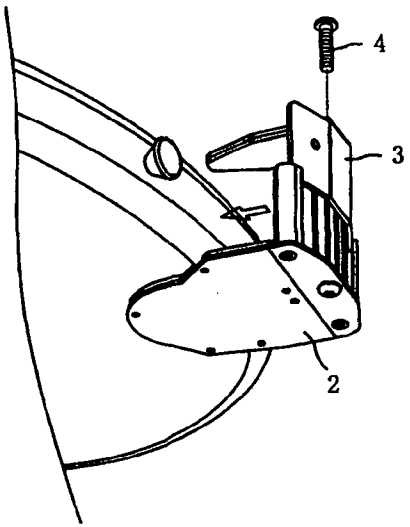
FIG. 7*b* shows a method in which the main control unit is disposed above the bridge of the stringed musical instrument, wherein the second holder is linked to the first holder.
Figure 7A:
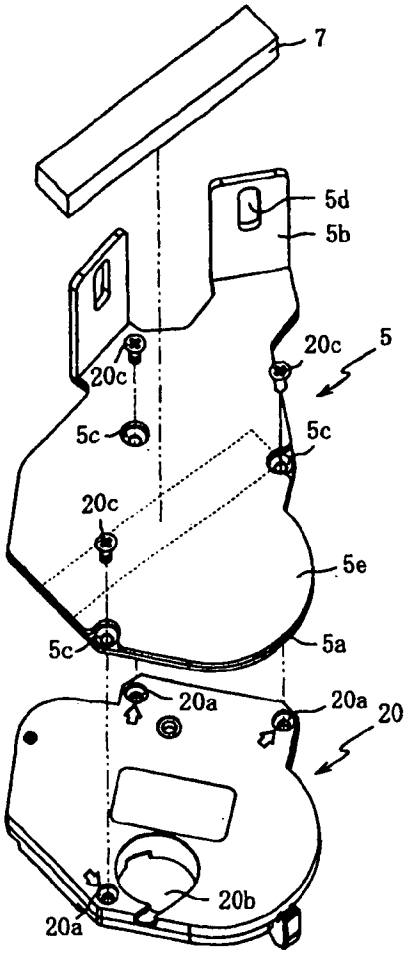
FIG. 7*a* shows a method in which the main control unit is disposed above the bridge of the stringed musical instrument, wherein the main control unit is fastened to the third holder.
Figure 8:
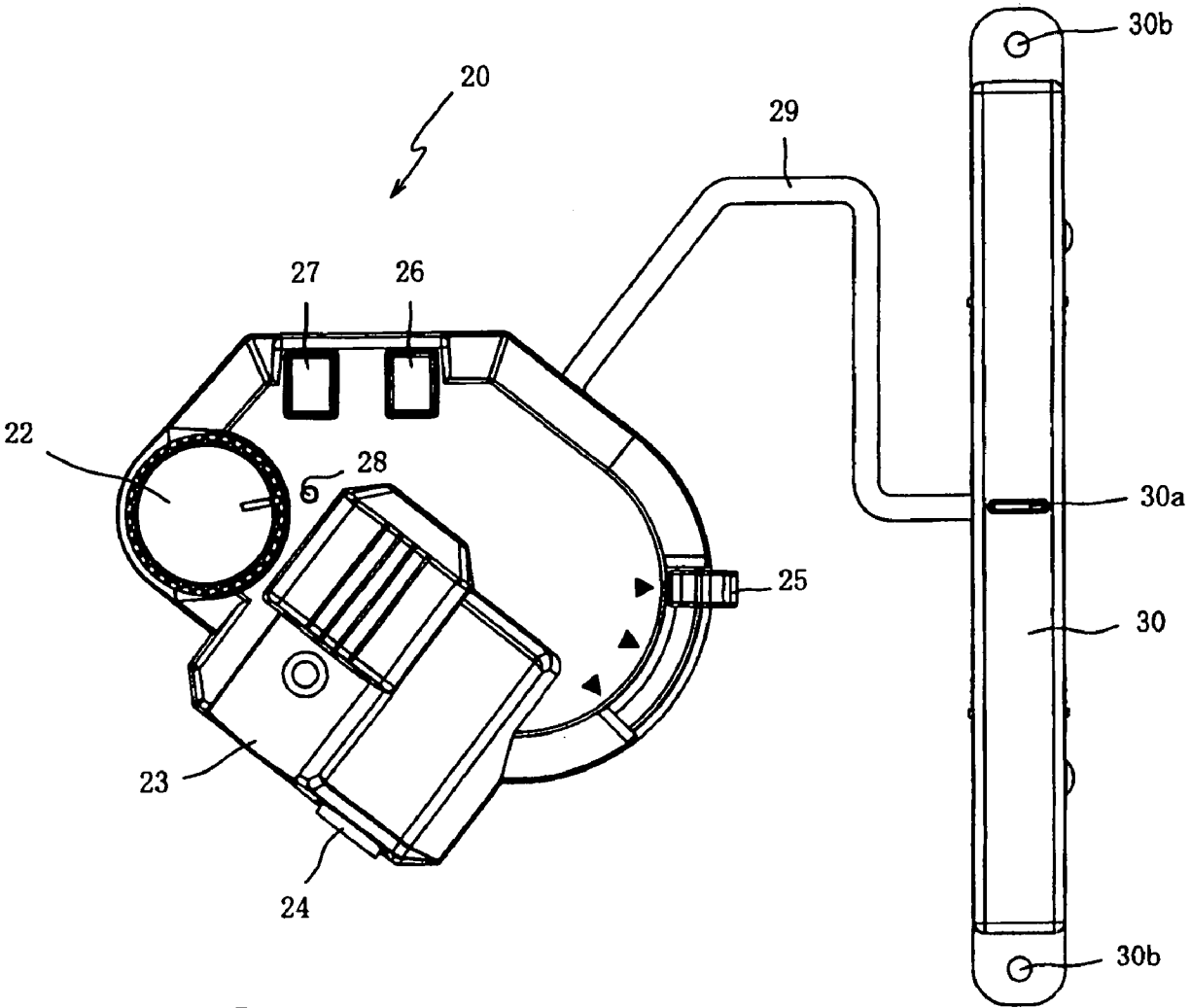
FIG 8 PRIOR ART
FIG. 8 is a drawing that shows a conventional pickup and a main control unit.
Figure 9A:
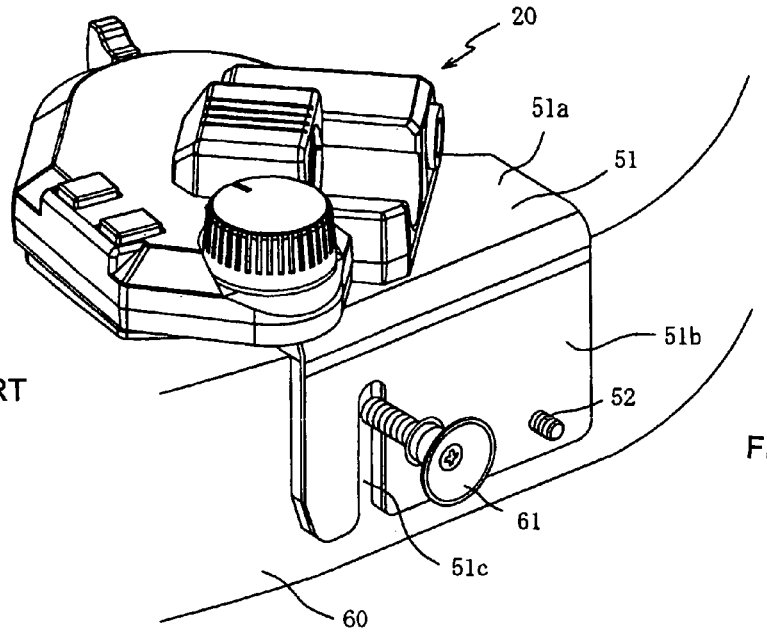
PRIOR ART FIG 9a
FIG. 9*a*-9*b* is a drawing that shows a conventional attachment apparatus in which a main control unit is attached.
Figure 9B:
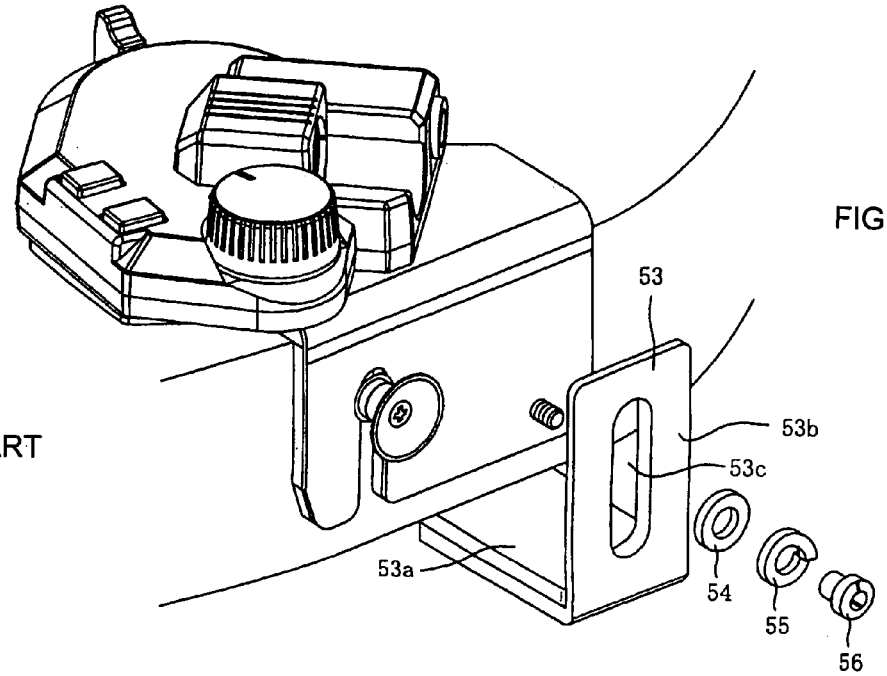
PRIOR ART FIG 9b

FIGS. 7*a*, 7*b*, and 7*c* show a condition in which the main control unit 20 is mounted above a bridge of the stringed musical instrument. FIG. 7*a* shows a condition in which the main control unit is fastened to the third holder 5. FIG. 7*b* shows a condition in which the second holder 3 is connected to the first holder 2 and the first and second holders are mounted on the stringed musical instrument. FIG. 7*c* shows a condition in which the third holder 5 is connected to the first holder 2 and the second holder 3.

FIG. 7*a* shows the condition in which the main control unit 20 is mounted on the third holder 5. When the third holder 5 is mounted on the body of the stringed musical instrument, a spacer 7 is affixed to the fourth cushion 5*e* and held between the cushion and the bridge so that the vibration of the strings is not impeded.

In a further embodiment of the present invention, the spacer 7 is made of foam rubber and affixed to the fourth cushion 5*e* by an adhesive. The flat screws 20*c* are inserted into the screw holes 5*c* in the attachment plate 5*a*, and the main control unit 20 is fastened to the upper surface of the attachment plate 5*a*.

FIG. 7*b* shows the condition in which the first contact plate 2*a* of the first holder 2 is in contact with the rear surface of the stringed musical instrument and the second contact plate 3*a* of the second holder 3 is in contact with the front surface of the stringed musical instrument and fastened to the stringed musical instrument. In this case, the two ends of the second side plate 3*b* of the second holder 3 follow along the guide grooves 2*k*, the middle portion of the second side plate 3*b* slides along the ribs 2*m*, and the mounting is done such that the body of the stringed musical instrument is held between the first contact plate 2*a* and the second contact plate 3*a*.

FIG. 7*c* shows the condition in which, as in FIG. 7*b*, the third holder 5, to which the main control unit 20 has been attached, is connected to the first holder 2 and the second holder 3 that have been mounted on the stringed musical instrument. First, the bolt 4 is inserted into the screw hole 3*d* on the second contact plate 3*a* and screwed into the female threads in the round hole 2*j* in the middle of the first side plate 2*c*. As a result, the body of the stringed musical instrument is held in a pressed state between the first holder 2 and the second holder 3.

Next, the elongated holes 5*d* on the side plates 5*b* of the third holder 5 are aligned with the female threads 3*e* in the second side plate 3*b* of the second holder 3 and the third holder 5 is disposed so that the spacer 7 is in contact with the bridge. In such a position, screws 6 are screwed down in two places along with flat washers 6*b* and spring washers 6*a*. In those cases where there is insufficient space to install the main control unit 20 close to the body of the stringed musical instrument, it is possible to mount the main control unit 20 above the bridge of the stringed musical instrument by using the third holder 5.

According to a preferred embodiment of the present invention, the main control unit 20 is fastened to the first holder 2 and by linking to the second holder 3 with the bolt 4, it is possible to easily mount the main control unit 20 on the front surface or the rear surface of the body of the stringed musical instrument. In addition, easy removal is possible by loosening the bolt 4 after mounting.

A further embodiment of the present invention addresses those cases where it is intended to mount the main control unit 20 on the front surface of the stringed musical instrument and where there is insufficient space on the front surface of the body of the stringed musical instrument. By assembling the third holder 5, it is possible to mount the control unit above the bridge of the stringed musical instrument.

An explanation was given above of embodiments of the present invention; however, the present invention is not limited to the specific embodiment described above. Various modifications and changes that do not deviate from and are within the scope of the essential aspects of the present invention can be easily surmised.

For example, in the specific embodiment, the bolt 4 that has been inserted in the screw hole 3*d* in the second holder 3 is coupled to the first side plate 2*c* that has been assembled on the first holder 2. As a result, the body of the stringed musical instrument is held between the first contact plate 2*a* and the second contact plate 3*a*. Conversely, a screw hole may be formed in the first holder 2 and female threads may be formed in the second side plate 3*b* of the second holder 3. By screwing in the bolt 4 through the screw hold in the first holder 2, the body of the stringed musical instrument is held between the first contact plate 2*a* and the second contact plate 3*a*.

What is claimed is:

1. An attachment apparatus for installing a main control unit on a stringed musical instrument having a front surface and a rear surface, the attachment apparatus comprising:

a first holder comprising a first contact plate in contact with the front surface or the rear surface of the stringed musical instrument and affixed to the main control unit;

a second holder comprising a second contact plate in contact with the rear surface or the front surface of the stringed musical instrument; and a linking element linking the first holder and the second holder such that the stringed musical instrument is pressed between the first contact plate and the second contact plate;

wherein the main control unit comprises electronic circuits that receive a signal output from a pickup that detects vibration of a string of the stringed musical instrument.

2. The attachment apparatus according to claim 1, wherein the first holder further comprises a first side plate having a first end portion and a second end portion, wherein the first side plate is joined with the first contact plate such that a first angle is formed and wherein each of the first end portion and the second end portion of the first side plate includes at least one groove along an axis that intersects the joint of the first side plate and the first contact plate;

wherein the second holder further comprises a second side plate having a first end portion and a second end portion, wherein the second side plate is joined with the second contact plate such that a second angle is formed; and wherein the first end portion of the second side plate slides along the at least one groove on the first end portion of the first side plate and the second end portion of the second side plate slides along the at least one groove on the second end portion of the first side plate.

3. The attachment apparatus according to claim 2, wherein the first side plate further comprises a first hole formed along the axis that intersects the joint of the first side plate and the first contact plate;

wherein the second side plate comprises a second hole; and and wherein the linking element comprises a bolt screwed though the first hole and the second hole.

4. The attachment apparatus according to claim 2, wherein the first angle is an acute angle.

5. The attachment apparatus according to claim 2, wherein the second angle is an acute angle.

6. The attachment apparatus according to claim 1, further comprising an elastic member either affixed to the first contact plate and disposed between the first contact plate and the stringed musical instrument or affixed to the second contact plate and disposed between the second contact plate and the stringed musical instrument.

7. The attachment apparatus according to claim 6, wherein the first elastic member and the second elastic member are formed from urethane foam.

8. The attachment apparatus according to claim 1, wherein the electronic circuits include a variable resistor; and wherein the variable resistor receives the signal output by the pickup, adjusts the signal level of the signal, and outputs an adjusted signal.

9. The attachment apparatus according to claim 8, wherein the main control unit further comprises a connector through which the main control unit outputs the adjusted signal to an external device.

10. The attachment apparatus according to claim 2, wherein the first side plate further comprises a curved surface that runs along a curvature of a side surface of the stringed musical instrument.

11. An attachment apparatus for installing a main control unit on a stringed musical instrument having a front surface and a rear surface, the attachment apparatus comprising:

a first holder comprising a first contact plate in contact with the front surface or the rear surface of the stringed musical instrument and affixed to the main control unit;

a second holder comprising a second contact plate in contact with the rear surface or the front surface of the stringed musical instrument; and a linking element linking the first holder and the second holder such that the stringed musical instrument is pressed between the first contact plate and the second contact plate;

wherein the first holder further comprises a first side plate having a first end portion and a second end portion, wherein the first side plate is joined with the first contact plate such that a first angle is formed and wherein each of the first end portion and the second end portion of the first side plate includes at least one groove along an axis that intersects the joint of the first side plate and the first contact plate;

wherein the second holder further comprises a second side plate having a first end portion and a second end portion, wherein the second side plate is joined with the second contact plate such that a second angle is formed;

wherein the first end portion of the second side plate slides along the at least one groove on the first end portion of the first side plate and the second end portion of the second side plate slides along the at least one groove on the second end portion of the first side plate;

wherein the first side plate further comprises a curved surface that runs along a curvature of a side surface of the stringed musical instrument; and wherein the curved surface of the first side plate comprises a first convex portion on the first end portion of the first side plate and a second convex portion on the second end portion of the first side plate and wherein both the first and the second convex portions contact the side surface of the stringed musical instrument.

12. An attachment apparatus for installing a main control unit on a stringed musical instrument having a front surface and a rear surface, the attachment apparatus comprising:

a first holder comprising a first contact plate in contact with the front surface or the rear surface of the stringed musical instrument and affixed to the main control unit;

a second holder comprising a second contact plate in contact with the rear surface or the front surface of the stringed musical instrument; and a linking element linking the first holder and the second holder such that the stringed musical instrument is pressed between the first contact plate and the second contact plate;

wherein the first holder further comprises a first side plate having a first end portion and a second end portion, wherein the first side plate is joined with the first contact plate such that a first angle is formed and wherein each of the first end portion and the second end portion of the first side plate includes at least one groove alone an axis that intersects the joint of the first side plate and the first contact plate;

wherein the second holder further comprises a second side plate having a first end portion and a second end portion, wherein the second side plate is joined with the second contact plate such that a second angle is formed;

wherein the first end portion of the second side plate slides along the at least one groove on the first end portion of the first side plate and the second end portion of the second side plate slides along the at least one groove on the second end portion of the first side plate;

wherein the first side plate is formed by an extrusion molding of aluminum;

wherein the first side plate further comprises a curved surface that runs along a curvature of a side surface of the stringed musical instrument;

wherein the second side plate is formed by a press molding of steel plate; and wherein the second side plate further comprises a plurality of flat surfaces, the plurality of flat surfaces arranged to generally conform in shape with the curved surface of the first side plate.

13. An attachment apparatus for installing a main control unit on a stringed musical instrument having a front surface and a rear surface, the attachment apparatus comprising:

a first holder comprising a first contact plate in contact with the rear surface of the stringed musical instrument;

a second holder comprising a second contact plate in contact with the front surface of the stringed musical instrument and smaller in surface area than the first contact plate;

a linking element linking the first holder and the second holder such that the stringed musical instrument is pressed between the first contact plate and the second contact plate; and a third holder comprising an attachment surface that is in contact with the main control unit, wherein the third holder is connected to at least one of the first or the second holders and wherein the attachment surface of the third holder is disposed roughly parallel to the second contact plate of the second holder.

14. The attachment apparatus according to claim 13, wherein the first holder further comprises a first side plate having a first end portion and a second end portion, wherein the first side plate is joined with the first contact plate such that a first angle is formed and wherein each of the first end portion and the second end portion of the first side plate includes at least one groove along an axis that intersects the joint of the first side plate and the first contact plate;

wherein the second holder further comprises a second side plate having a first end portion and a second end portion, wherein the second side plate is joined with the second contact plate such that a second angle is formed; and wherein the first end portion of the second side plate slides along the at least one groove on the first end portion of the first side plate and the second end portion of the second side plate slides along the at least one groove on the second end portion of the first side plate.

15. The attachment apparatus according to claim 14, wherein the first angle is an acute angle.

16. The attachment apparatus according to claim 14, wherein the second angle is an acute angle.

17. The attachment apparatus according to claim 13, further comprising an elastic member either affixed to the first contact plate and disposed between the first contact plate and the stringed musical instrument or affixed to the second contact plate and disposed between the second contact plate and the stringed musical instrument.

18. The attachment apparatus according to claim 17, wherein the first elastic member and the second elastic member are formed from urethane foam.

19. The attachment apparatus according to claim 14, wherein the first side plate further comprises a curved surface that runs along a curvature of a side surface of the stringed musical instrument.

20. The attachment apparatus according to claim 19, wherein the curved surface of the first side plate comprises a first convex portion on the first end portion of the first side plate and a second convex portion on the second end portion of the first side plate and wherein both the first and the second convex portions contact the side surface of the stringed musical instrument.

21. The attachment apparatus according to claim 14, wherein the first side plate is formed by an extrusion molding of aluminum;

wherein the first side plate further comprises a curved surface that runs along a curvature of a side surface of the stringed musical instrument;

wherein the second side plate is formed by a press molding of steel plate, and wherein the second side plate further comprises a plurality of flat surfaces, the plurality of flat surfaces arranged to generally conform in shape with the curved surface of the first side plate.

22. The attachment apparatus according to claim 14, wherein the first side plate further comprises a first hole formed along the axis that intersects the joint of the first side plate and the first contact plate;

wherein the second side plate comprises a second hole; and and wherein the linking element comprises a bolt screwed through the first hole and the second hole.

23. The attachment apparatus according to claim 13, wherein the main control unit comprises electronic circuits that receive a signal output from a pickup that detects vibration of a string of the stringed musical instrument.

24. The attachment apparatus according to claim 23, wherein the electronic circuits include a variable resistor; and wherein the variable resistor receives the signal output by the pickup, adjusts the signal level of the signal, and outputs an adjusted signal.

25. The attachment apparatus according to claim 24, wherein the main control unit further comprises a connector through which the main control unit outputs the adjusted signal to an external device.

26. An apparatus for installing an external unit on a stringed musical instrument, the apparatus comprising:

a first holder comprising a first member disposed opposite to either a front surface of the stringed musical instrument or a rear surface of the stringed musical instrument;

a second holder comprising a second member, wherein, upon the first member being disposed opposite to the front surface of the stringed musical instrument, the second member is disposed opposite to the rear surface of the stringed musical instrument and wherein, upon the first member being disposed opposite to the rear surface of the stringed musical instrument, the second member is disposed opposite to the front surface of the stringed musical instrument; and a linking member that links to a degree of tightness the first holder and the second holder, a third holder comprising a third member; and a second linking member that links the second holder and the third holder, wherein the external unit is attached to the apparatus;

wherein a force by which the first holder and the second holder squeeze the front and the rear surfaces of the stringed musical instrument is proportional to the degree of tightness to which the linking member links the first and the second holders;

wherein the first member is disposed opposite to the rear surface of the stringed musical instrument and the second member is disposed opposite to the front surface of the stringed musical instrument; and wherein the external unit is attached to the third member.

27. The apparatus according to claim 26, wherein the first holder further comprises a fourth member having a first end portion and a second end portion, wherein the first and the fourth members are joined along a first axis and wherein each of the first and the second end portions of the fourth member includes at least one groove along a second axis that intersects the first axis;

wherein the second holder further comprises a fifth member having a first end portion and a second end portion, wherein the second member is joined with the fifth member;

wherein the fifth member is interlocked with the fourth member upon sliding the first end of the fifth member along the at least one groove on the first end of the fourth member and sliding the second end of the fifth member along the at least one groove on the second end of the fourth member;

wherein the third holder further comprises a sixth member;

wherein the second linking member links the sixth member to the fifth member; and wherein the third member is disposed opposite to the front surface of the stringed musical instrument.

28. An apparatus for installing an external unit on a stringed musical instrument, the apparatus comprising:

a first holder comprising a first member disposed opposite to either a front surface of the stringed musical instrument or a rear surface of the stringed musical instrument;

a second holder comprising a second member, wherein, upon the first member being disposed opposite to the front surface of the stringed musical instrument, the second member is disposed opposite to the rear surface of the stringed musical instrument and wherein, upon the first member being disposed opposite to the rear surface of the stringed musical instrument, the second member is disposed opposite to the front surface of the stringed musical instrument; and a linking member that links to a degree of tightness the first holder and the second holder, wherein the external unit is attached to the apparatus;

wherein a force by which the first holder and the second holder squeeze the front and the rear surfaces of the stringed musical instrument is proportional to the degree of tightness to which the linking member links the first and the second holders;

wherein the first holder further comprises a third member having a first end portion and a second end portion, wherein the first and the third members are joined along a first axis and wherein each of the first and the second end portions of the third member includes at least one groove along a second axis that intersects the first axis;

wherein the second holder further comprises a fourth member having a first end portion and a second end portion, wherein the fourth member is joined with the second member; and wherein the fourth member is interlocked with the third member upon sliding the first end portion of the fourth member along the at least one groove on the first end portion of the third member and sliding the second end portion of the fourth member along the at least one groove on the second end portion of the third member.

29. A method for installing an external unit on a stringed musical instrument, the method comprising steps of:

providing a first holder comprising a first member;

disposing the first member opposite to either a front surface of the stringed musical instrument or a rear surface of the stringed musical instrument;

providing a second holder comprising a second member, wherein, upon the first member being disposed opposite to the front surface of the stringed musical instrument, the second member is disposed opposite to the rear surface of the stringed musical instrument, and wherein, upon the first member being disposed opposite to the rear surface of the stringed musical instrument, the second member is disposed opposite to the front surface of the stringed musical instrument;

linking to a degree of tightness the first holder and the second holder, providing a third holder comprising a third member; and linking the second holder and the third holder;

wherein a force by which the first holder and the second holder squeeze the front and the rear surfaces of the stringed musical instrument is proportional to the degree of tightness to which the first and the second holders are linked;

wherein the external unit is installed on the stringed musical instrument via the linked first and second holders;

wherein the first member is disposed opposite to the rear surface of the stringed musical instrument and the second member is disposed opposite to the front surface of the stringed musical instrument; and wherein the external unit is installed on the stringed musical instrument by attaching the external unit to the third member.

30. A method for installing an external unit on a stringed musical instrument, the method comprising steps of:

providing a first holder comprising a first member;

disposing the first member opposite to either a front surface of the stringed musical instrument or a rear surface of the stringed musical instrument;

providing a second holder comprising a second member, wherein, upon the first member being disposed opposite to the front surface of the stringed musical instrument, the second member is disposed opposite to the rear surface of the stringed musical instrument, and wherein, upon the first member being disposed opposite to the rear surface of the stringed musical instrument, the second member is disposed opposite to the front surface of the stringed musical instrument;

linking to a degree of tightness the first holder and the second holder;

joining along a first axis the first member with a third member of the first holder;

joining the second member with a fourth member of the second holder; and interlocking the fourth member with the third member, wherein a force by which the first holder and the second holder squeeze the front and the rear surfaces of the stringed musical instrument is proportional to the degree of tightness to which the first and the second holders are linked;

wherein the external unit is installed on the stringed musical instrument via the linked first and second holders wherein the third member has a first end portion and a second end portion, wherein each of the first and the second end portions of the third member includes at least one groove along a second axis that intersects the first axis;

wherein the fourth member has a first end portion and a second end portion; and wherein the interlocking of the fourth member with the third member occurs upon sliding the first end portion of the fourth member along the at least one groove on the first end portion of the third member and sliding the second end portion of the fourth member along the at least one groove on the second end portion of the third member.

31. The method according to claim 29, further comprising steps of:

joining along a first axis the first member with a fourth member of the first holder;

joining the second member with a fifth member of the second holder; and interlocking the fifth member with the third member, wherein the fourth member has a first end portion and a second end portion, wherein each of the first and the second end portions of the fourth member includes at least one groove along a second axis thin intersects the first axis;

wherein the fifth member has a first end portion and a second end portion;

wherein the interlocking of the fifth member with the fourth member occurs upon sliding the first end portion of the fifth member along the at least one groove on the first end portion of the fourth member and sliding the second end portion of the fifth member along the at least one groove on the second end portion of the fourth member;

wherein the linking of the second holder and the third holder comprises linking the fifth member with a sixth member of the third holder; and wherein the third member is disposed opposite to the front surface of the stringed musical instrument.

* * * * *